US009958242B2

(12) United States Patent
Sullivan et al.

(10) Patent No.: US 9,958,242 B2
(45) Date of Patent: May 1, 2018

(54) PAYLOAD CARRYING ARRANGEMENT FOR A NON-LETHAL PROJECTILE

(71) Applicant: Security Devices International, Inc., Fitchburg, MA (US)

(72) Inventors: Gregory Barry Sullivan, Burlington (CA); Dean Gregory Thrasher, Oakville (CA)

(73) Assignee: Security Devices International Inc., Fitchburg, MA (US)

( * ) Notice: Subject to any disclaimer, the term of this patent is extended or adjusted under 35 U.S.C. 154(b) by 0 days. days.

(21) Appl. No.: 15/209,428

(22) Filed: Jul. 13, 2016

(65) Prior Publication Data

US 2016/0320167 A1 Nov. 3, 2016

Related U.S. Application Data

(63) Continuation of application No. PCT/US2014/044892, filed on Jun. 30, 2014.

(60) Provisional application No. 61/926,728, filed on Jan. 13, 2014.

(51) Int. Cl.

| | |
|---|---|
| ***F42B 12/40*** | (2006.01) |
| ***F42B 12/46*** | (2006.01) |
| ***F42B 12/50*** | (2006.01) |

(52) U.S. Cl.

CPC ..... *F42B 12/40* (2013.01); *F42B 12/46* (2013.01); *F42B 12/50* (2013.01)

(58) Field of Classification Search

CPC ..... F42B 12/34; F42B 12/36; F42B 12/40; F42B 12/46; F42B 12/50; F42B 12/54

USPC ..... 102/370, 502, 512, 513

See application file for complete search history.

(56) References Cited

U.S. PATENT DOCUMENTS

| | | | | |
|---|---|---|---|---|
| 3,865,038 | A | 2/1975 | Barr | |
| 3,894,492 | A | 7/1975 | Barr | |
| 3,911,824 | A | 10/1975 | Barr | |
| H114 | H * | 8/1986 | Quintavalle | 102/513 |
| 5,035,183 | A | 7/1991 | Luxton | |
| 6,209,461 | B1 | 4/2001 | Riffet et al. | |
| 6,647,890 | B2 | 11/2003 | Findlay | |
| 6,736,070 | B2 | 5/2004 | Baltos | |

(Continued)

FOREIGN PATENT DOCUMENTS

| | | |
|---|---|---|
| CA | 2038100 C | 9/1991 |
| DE | 3038936 | 2/2009 |

(Continued)

OTHER PUBLICATIONS

Written Opinion in PCT/US14/44892; dated Oct. 28, 2014.*

(Continued)

*Primary Examiner* — James S Bergin

(74) *Attorney, Agent, or Firm* — Simpson & Simpson, PLLC

(57) ABSTRACT

A payload dispersion system for a non-lethal projectile including a resilient layer and a marker packet having a hollow body including a lower surface, at least a partial opening centrally disposed, an upper surface, a volume formed by the lower surface, the at least a partial opening and the upper surface and a payload contained within the volume. The upper surface of the marker packet includes a wall and at least one weakened portion within the wall. The lower surface of the marker packet contacts an upper surface of the resilient layer.

9 Claims, 15 Drawing Sheets

(56) References Cited

U.S. PATENT DOCUMENTS

| | | | | |
|---|---|---|---|---|
| 7,021,219 | B1 | 4/2006 | Dindl | |
| 7,143,699 | B2 * | 12/2006 | Brock | F42B 8/14 102/502 |
| 7,287,475 | B2 | 10/2007 | Brunn | |
| 7,475,638 | B2 | 1/2009 | Haselich | |
| 7,526,998 | B2 | 5/2009 | Vasel et al. | |
| 7,549,376 | B1 | 6/2009 | Grossman | |
| 7,819,065 | B2 | 10/2010 | Haselich | |
| 7,861,657 | B2 | 1/2011 | Danon et al. | |
| 7,913,626 | B1 | 3/2011 | Reinhardt et al. | |
| 8,061,276 | B2 | 11/2011 | Danon et al. | |
| 8,065,962 | B2 | 11/2011 | Haselich | |
| 8,327,768 | B2 | 12/2012 | Scarr | |
| 8,424,456 | B2 | 4/2013 | Broden et al. | |
| 8,485,102 | B2 | 7/2013 | Carlson et al. | |
| 8,640,621 | B2 | 2/2014 | Broden et al. | |
| 8,813,652 | B2 | 8/2014 | Shin et al. | |
| 8,881,655 | B2 * | 11/2014 | Aw | F42B 12/40 102/512 |
| 2004/0089186 | A1 | 5/2004 | Brygdes-Price | |
| 2005/0066849 | A1 | 3/2005 | Kapeles et al. | |
| 2005/0229807 | A1 | 10/2005 | Brock et al. | |
| 2006/0011090 | A1 | 1/2006 | Vasel et al. | |
| 2008/0178728 | A1 | 7/2008 | Kapeles et al. | |
| 2008/0178758 | A1 | 7/2008 | Kapeles et al. | |
| 2009/0101038 | A1 | 4/2009 | Kapeles et al. | |
| 2009/0266262 | A1 | 10/2009 | Vasel et al. | |
| 2011/0252995 | A1 | 10/2011 | Dindl et al. | |
| 2012/0291655 | A1 | 11/2012 | Jones | |
| 2013/0199396 | A1 | 8/2013 | Broden et al. | |
| 2014/0041545 | A1 | 2/2014 | Aw et al. | |

FOREIGN PATENT DOCUMENTS

| | | |
|---|---|---|
| DE | 102008046246 | 3/2010 |
| WO | WO2006/007738 | 1/2006 |
| WO | 2011130550 A2 | 10/2011 |

OTHER PUBLICATIONS

International Search report in PCT/US14/44892; dated Oct. 28, 2014.*

U.S. Statutory Invention Registration No. H114, Published Aug. 5, 1986 (Quintavalle).

* cited by examiner

PAYLOAD CARRYING ARRANGEMENT FOR A NON-LETHAL PROJECTILE

CROSS-REFERENCE TO RELATED APPLICATIONS

This patent application is a Continuation of International Patent Application No. PCT/US2014/044892, filed on Jun. 30, 2014, which patent application claims the benefit under 35 U.S.C. § 119(e) and Article 4 of the Stockholm Act of the Paris Convention for the Protection of Industrial Property of U.S. Provisional Patent Application No. 61/926,728, filed Jan. 13, 2014, which applications are incorporated herein by reference in their entireties.

FIELD OF THE INVENTION

The invention broadly relates to non-lethal projectiles, more specifically to payload carrying non-lethal projectiles, and even more particularly to a payload carrying non-lethal projectile arranged to disburse its payload evenly upon impact with a target.

BACKGROUND OF TUE INVENTION

Non-lethal projectiles are well known in the art. For example, U.S. Pat. No. 7,861,657, issued on Jan. 4, 2011, the entirety of which is incorporated herein by reference, discloses a non-lethal projectile comprising a deformable head arranged to absorb kinetic energy upon impact of the projectile with a target.

In addition to or as an alternative to a deformable head, non-lethal projectiles may comprise a variety of head designs some of which may be arranged to carry a payload. Such payloads may include but are not limited to malodorant, marking liquid, marking powder, pepper liquid and pepper powder. An example of a payload carrying non-lethal projectile is disclosed in United States Patent Application Publication No. 2005/0066849, which published on Mar. 31, 2005, the entirety of which is incorporated herein by reference. The device disclosed in the foregoing publication includes a nose portion formed from a frangible, rigid, polymer foam material such that the nose crushes upon impact with a target to disperse energy, thereby reducing the kinetic energy transferred to the target while simultaneously dispensing its payload, e.g., marker agents, lacrimators, irritants, inflammatory agents, odorants or inert powders.

Non-lethal projectiles known in the art suffer from a variety of drawbacks. For example, known projectile head arrangements fail to provide a controlled dispensing of a payload. Such payloads are randomly and unpredictably dispersed upon impact. Such a condition may decrease the effectiveness of the payload as it may fail to reach its desired location or desired extent of dispersion. Additionally, tradeoffs between kinetic energy dissipation and quantities and types of payloads have been required. For example, frangible powder payloads do not dissipate kinetic energy to the same extent as a viscoelastic material such as a silicone rubber polymer. Similarly, liquid payloads offer a hydro-impact effect to lessen inertia upon impacting a target.

BRIEF SUMMARY OF THE INVENTION

The present invention broadly comprises a non-lethal projectile including a frame, a guide expander, an expander cap, a resilient layer, a marker packet and a cap. The frame includes a substantially cylindrical hollow body, a closed upper end and a through bore centrally disposed within the closed upper end and coaxially arranged with the substantially cylindrical body. The guide expander includes a cylindrical guide and a base, wherein the cylindrical guide is disposed within the bore and longitudinally displaceable therein. The expander base includes a plurality of segments, a lower protrusion and an upper protrusion, wherein the guide expander contacts the lower protrusion and each segment of the plurality of segments is connected to each adjacent segment by a weakened portion. The expander cap includes an upper surface having a plurality of offset circular planar surfaces and a through bore centrally disposed and contacting the upper protrusion of the expander base, wherein the upper surface of the expander cap contacts a lower surface of the resilient layer. The marker packet includes a hollow body having a lower surface, at least a partial opening centrally disposed, an upper surface, a volume formed by the lower surface, the at least a partial opening and the upper surface, and a payload contained within the volume. The upper surface of the marker packet includes a wall and at least one weakened portion within the wall, and the lower surface of the marker packet contacts an upper surface of the resilient layer. The cap is arranged to enclose the marker packet, the resilient. expander and the expander cap, and partially enclose the expander base, wherein the payload is dispersed on or near a target upon impact by the non-lethal projectile.

The present invention also broadly comprises a non-lethal projectile having a frame, a guide expander, an expander cap, a resilient expander, a marker packet and a cap. The frame includes a substantially cylindrical hollow body, a closed upper end and a through bore centrally disposed within the closed upper end and coaxially arranged with the substantially cylindrical body. The guide expander includes a cylindrical guide and a base, wherein the cylindrical guide is disposed within the bore and longitudinally displaceable therein. The expander base includes a plurality of segments, a lower protrusion and an upper protrusion, wherein the guide expander contacts the tower protrusion and each segment of the plurality of segments is connected to each adjacent segment by a weakened portion. The expander cap includes an upper surface having a plurality of offset circular planar surfaces and a through bore centrally disposed and contacting the upper protrusion of the expander base. The resilient expander includes a base and an extension, wherein the upper surface of the expander cap contacts a lower surface of the base. The marker packet includes a hollow body having a lower surface, a central opening, an upper surface, a volume formed by the lower surface, the central opening and the upper surface and a payload contained within the volume, wherein the upper surface of the marker packet includes a plurality of segments, each segment of the plurality of segments is connected to each adjacent segment by a weakened portion, the extension of the resilient expander is disposed within the central opening, and the lower surface of the marker packet contacts an upper surface of the base of the resilient expander. The cap is arranged to enclose the marker packet, the resilient expander and the expander cap, and partially enclose the expander base, wherein the payload is dispersed on or near a target upon impact by the non-lethal projectile.

The present invention further broadly comprises a payload dispersion system for a non-lethal projectile including a resilient layer and a marker packet having a hollow body including a lower surface, at least a partial opening centrally disposed, an upper surface, a volume formed. by the tower surface, the at least a partial opening and the upper surface, and a payload contained within the volume, wherein the upper surface of the marker packet includes a wall and at least one weakened portion within the wall, and the lower surface of the marker packet contacts an upper surface of the resilient layer.

The present invention yet further broadly comprises a payload dispersion system for a non-lethal projectile including a resilient expander having a base and an extension, and a marker packet having a hollow body including a lower surface, a central opening, an upper surface, a volume formed by the lower surface, the central opening and the upper surface and a payload contained within the volume, Wherein the upper surface the marker packet includes a plurality of segments, each segment of the plurality of segments is connected to each adjacent segment by a weakened portion, the extension of the resilient expander is disposed within the central opening, and the lower surface of the marker packet contacts an upper surface of the base of the resilient expander.

The present invention also broadly comprises a payload carrying packet for a non-lethal projectile including a hollow body having a tower surface, at least a partial opening centrally disposed, an upper surface, a volume formed by the lower surface, the at least a partial opening and the upper surface and a payload contained within the volume, wherein the upper surface of the marker packet includes a wall and at least one weakened portion within the wall.

The present invention still further broadly comprises a dispersion article for use in combination with a payload carrying packet for a non-lethal projectile including a resilient expander having a base and an extension, wherein application of a longitudinal force on the extension causes the extension to expand outwardly and pressurize the payload packet.

It is a general object of the present invention to provide a non-lethal projectile that maximizes the safety of its use.

It is another general object of the present invention to provide a non-lethal projectile that disperses a payload, e.g. a malodorant or marking liquid, substantially evenly upon impact with a target.

It is yet another general object of the present invention to provide a non-lethal projectile that disperses impact forces substantially evenly upon impact with a target, wherein the dispersed forces are non-lethal is magnitude.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
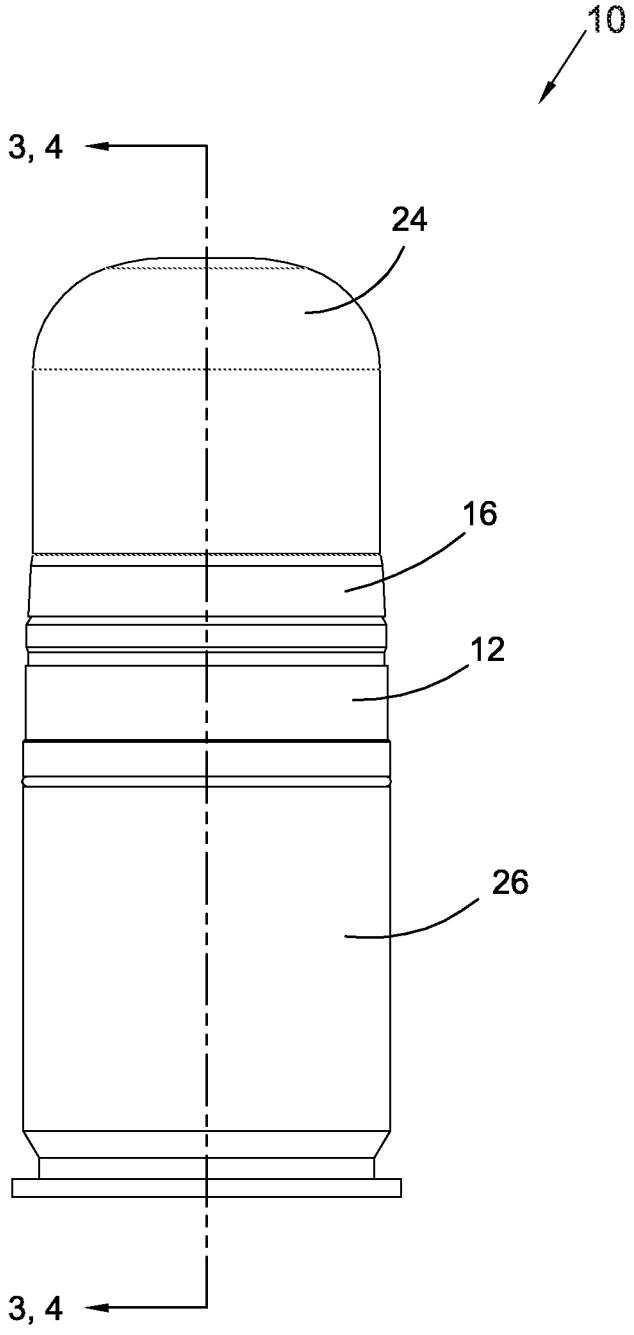
FIG. 1 is a side elevational view of an embodiment of a present invention non-lethal projectile.
Figure 2:
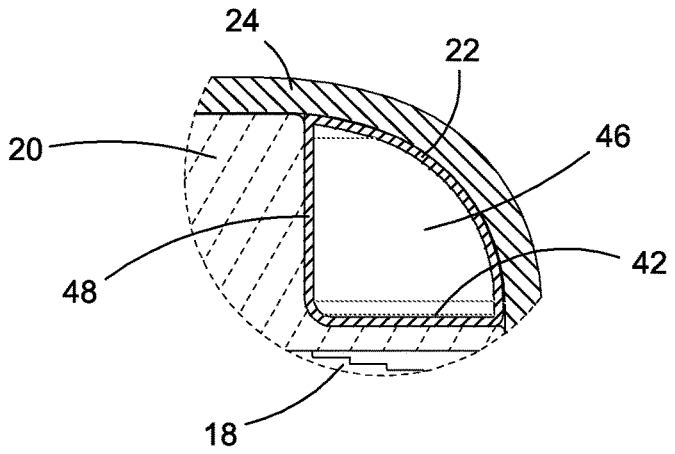
FIG. 2 is an enlarged cross sectional view of the encircled region 2 shown in FIG. 3.
Figure 3:
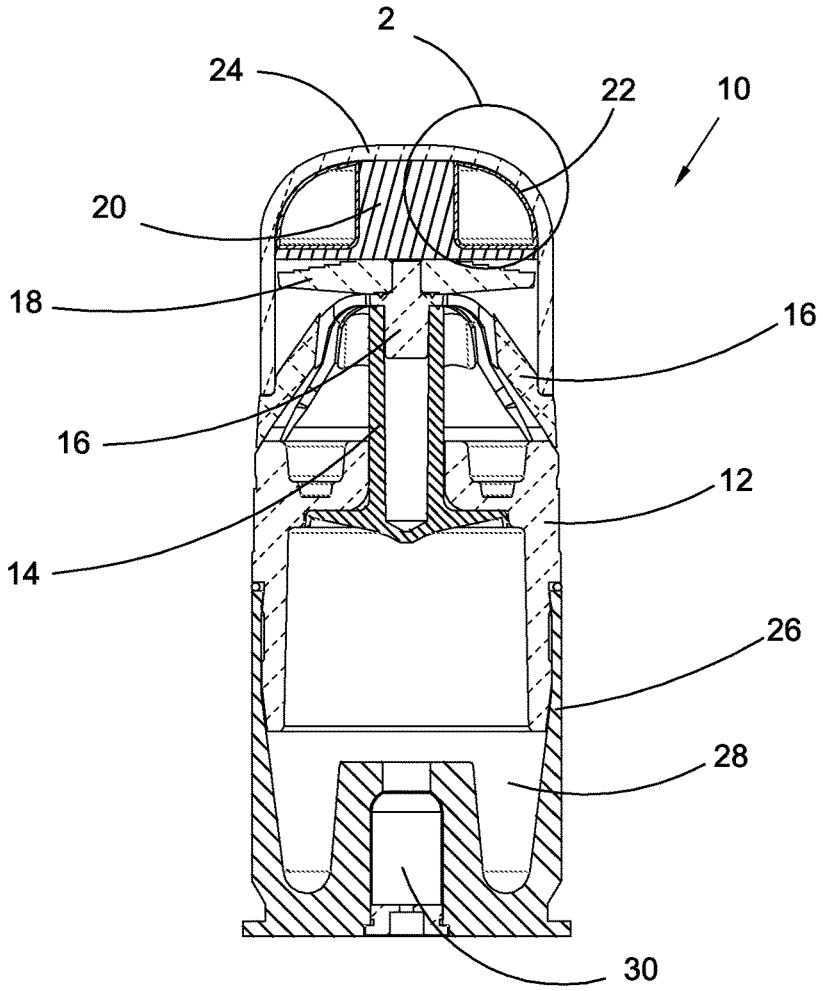
FIG. 3 is a cross sectional view of the non-lethal projectile shown in FIG. 1 taken generally along line 3-3 of FIG. 1.
Figure 4:
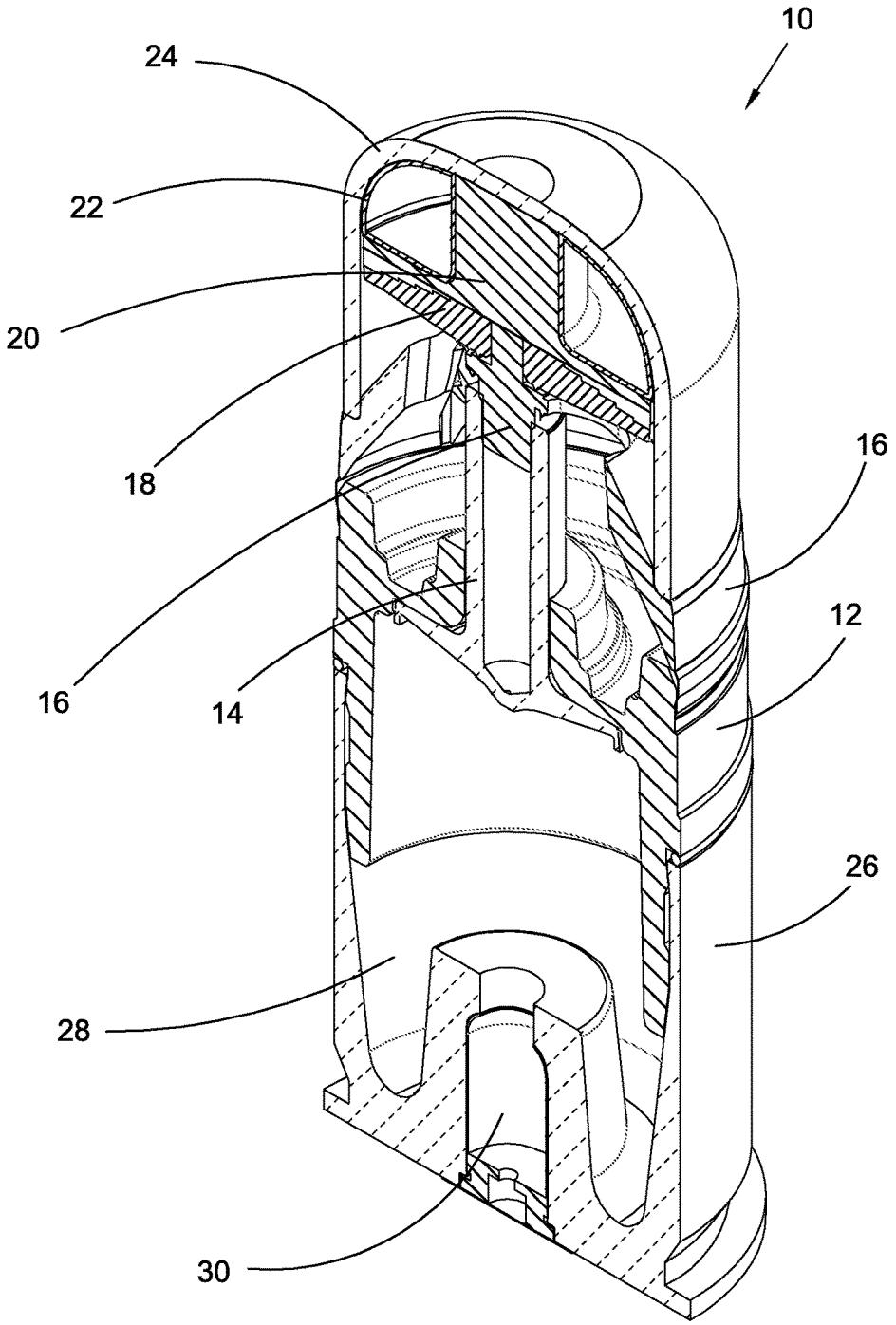
FIG. 4 is a cross sectional perspective view of the non-lethal projectile shown in FIG. 1 taken generally along line 4-4 of FIG. 1.
Figure 5:
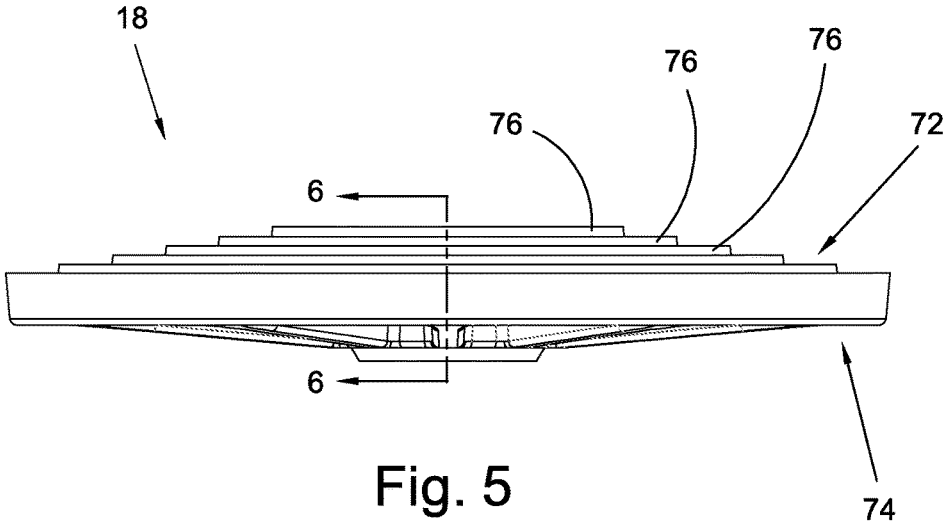
FIG. 5 is a side elevational view of an embodiment of an expander cap used in the embodiment of the non-lethal projectile shown in FIG. 1.
Figure 6:
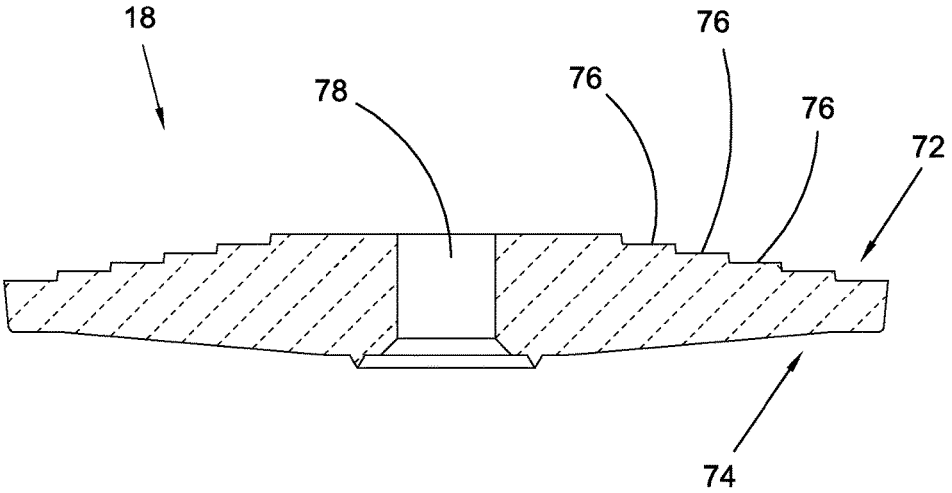
FIG. 6 is a cross sectional view of the expander cap shown in FIG. 5 taken generally along line 6-6 of FIG. 5.
Figure 7:
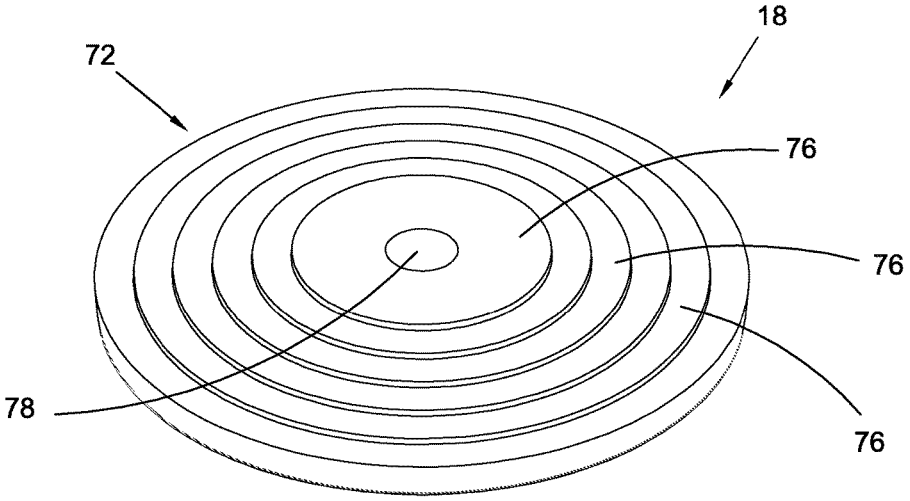
FIG. 7 is a top perspective view of the expander cap shown in FIG. 5.
Figure 8:
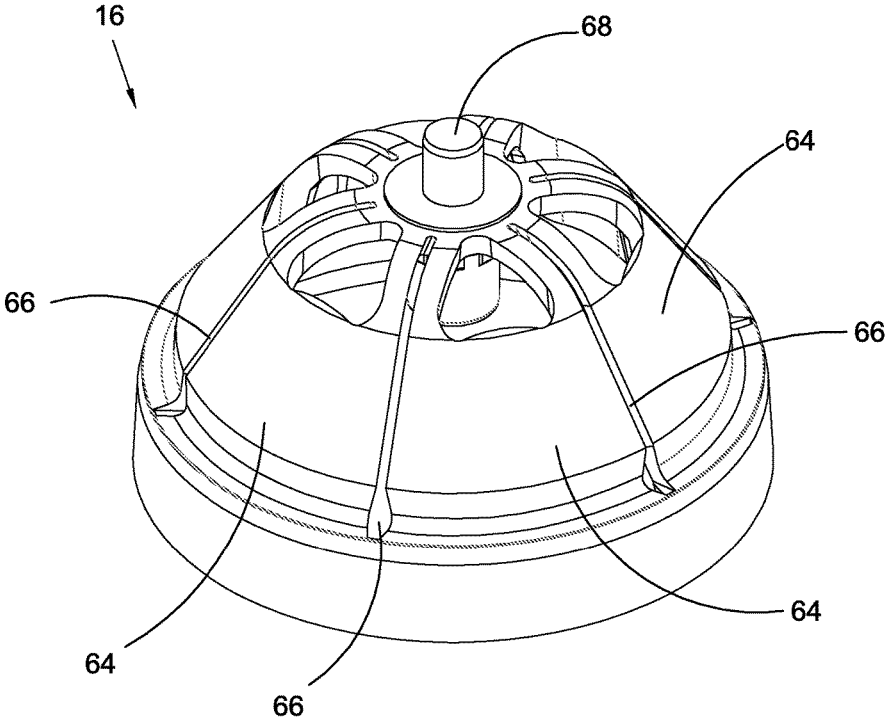
FIG. 8 is a top perspective view of an embodiment of an expander base used in the embodiment of the non-lethal projectile shown in FIG. 1.
Figure 9:
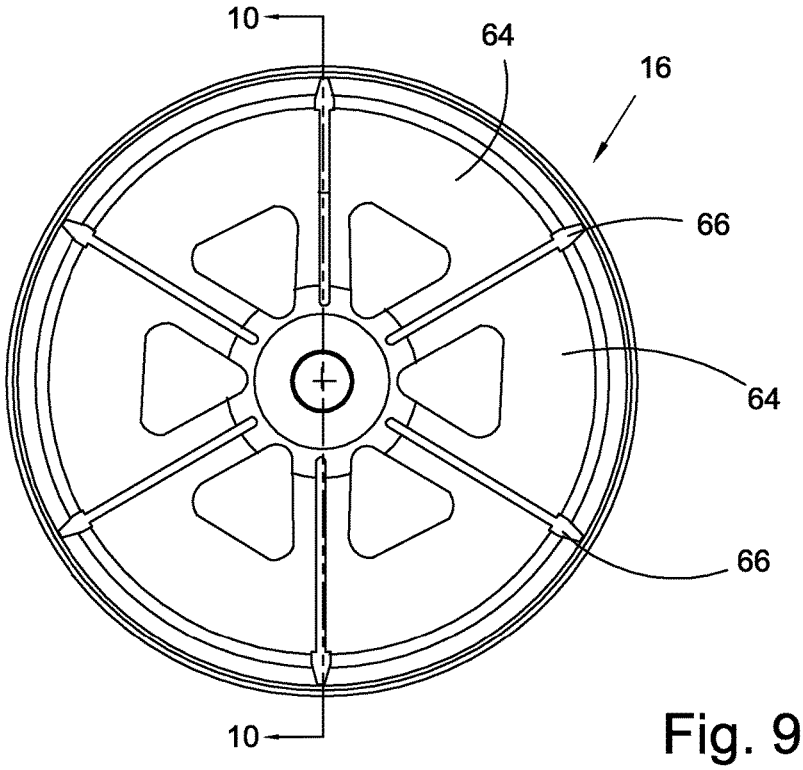
FIG. 9 is a top plan view of the expander base shown in FIG. 8.
Figure 10:
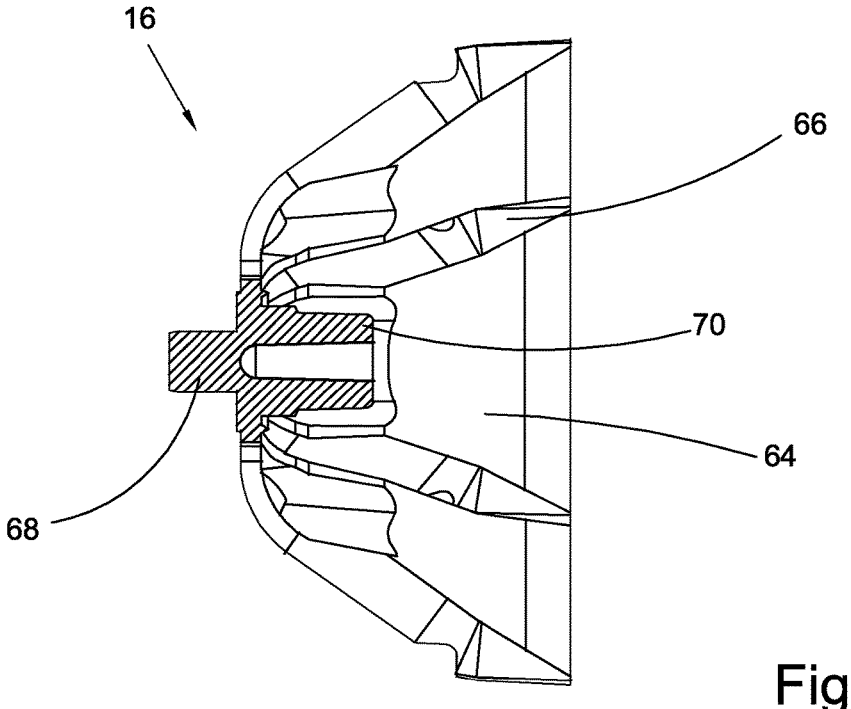
FIG. 10 is a cross-sectional view of the expander base shown in FIG. 8 taken generally along line 10-10 of FIG. 9.
Figure 11:
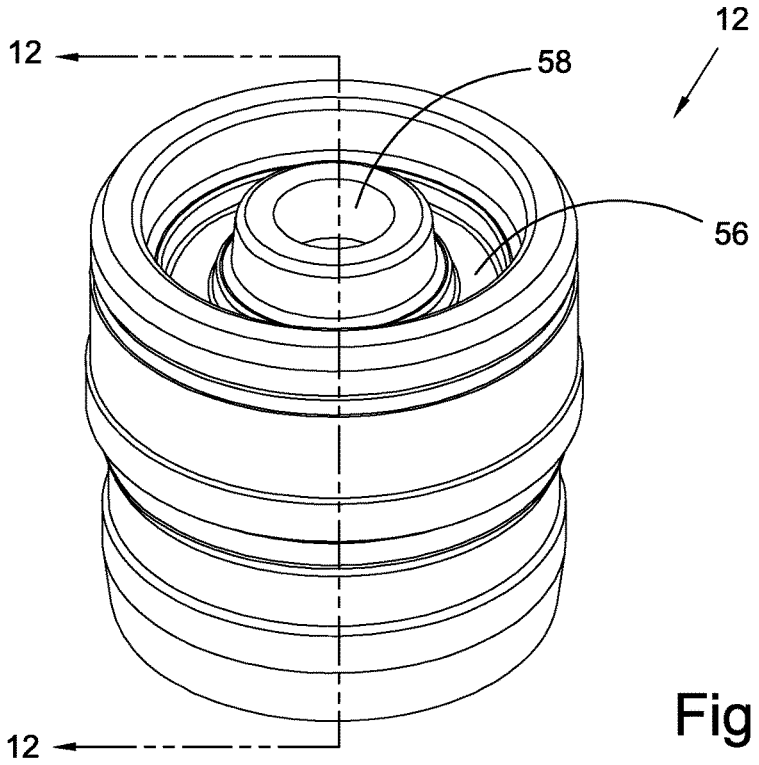
FIG. 11 is a top perspective view of an embodiment of a projectile frame used in the embodiment of the non-lethal projectile shown in FIG. 1.
Figure 12:
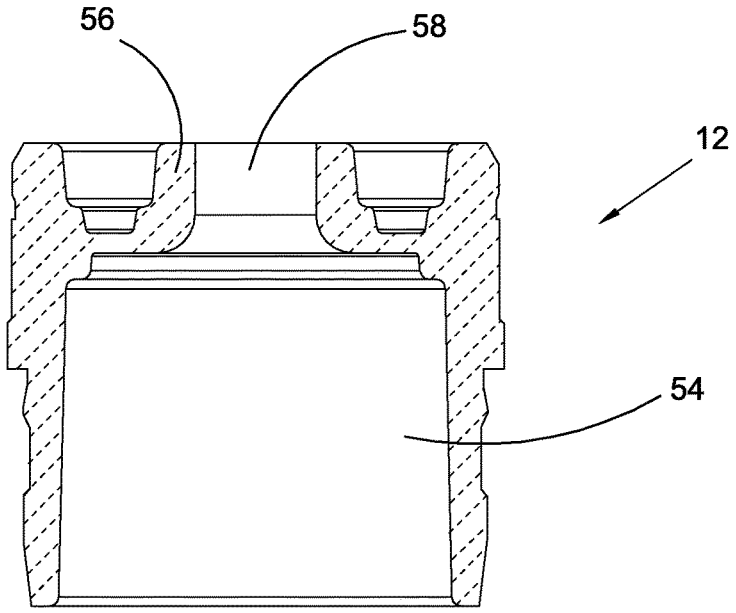
FIG. 12 is a cross-sectional view of the projectile frame shown in FIG. 11 taken generally along line 12-12 of FIG. 11.
Figure 13:
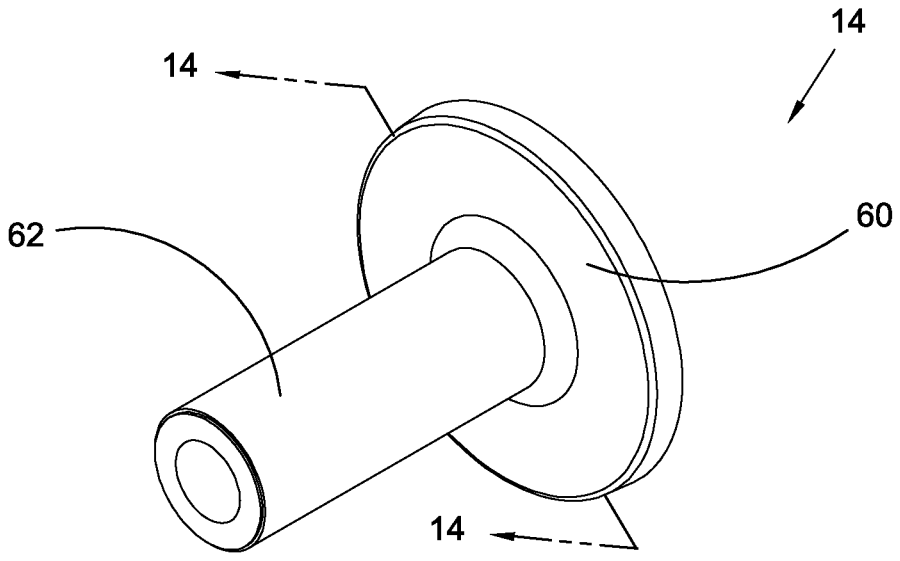
FIG. 13 is a perspective view of an embodiment of a guide expander used in the embodiment of the non-lethal projectile shown in FIG. 1.
Figure 14:
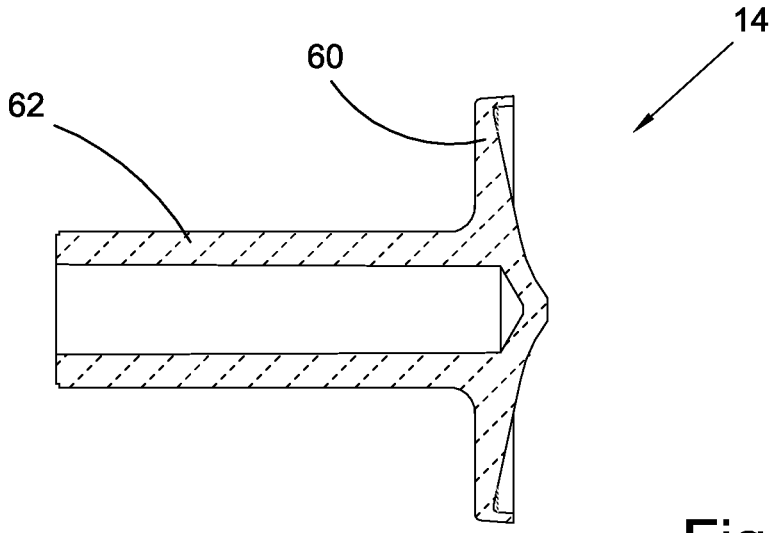
FIG. 14 is a cross-sectional view of the guide expander shown in FIG. 13 taken generally along line 14-14 of FIG. 13.
Figure 15:
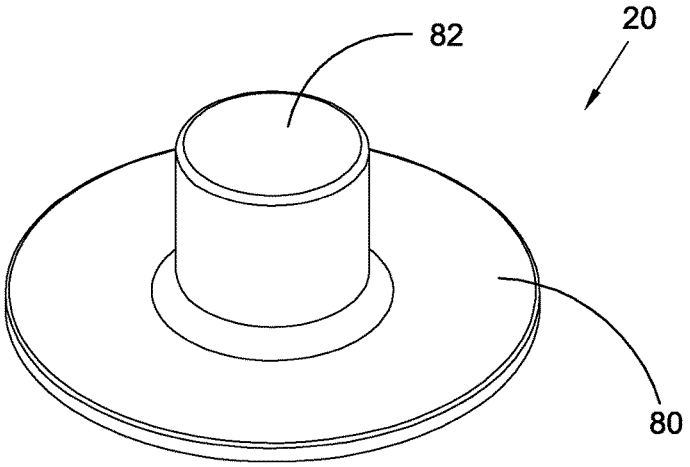
FIG. 15 is a perspective view of an embodiment of a resilient expander used in the embodiment of the non-lethal projectile shown in FIG. 1.
Figure 16:
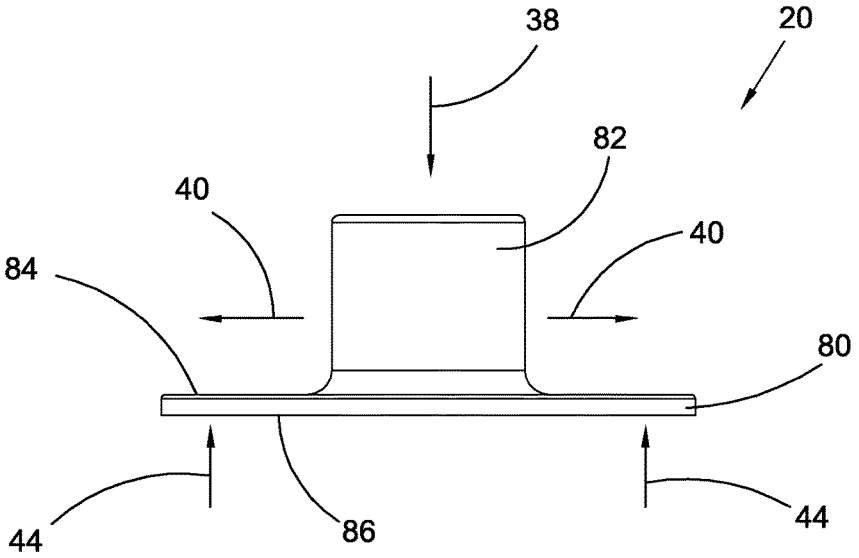
FIG. 16 is a side elevational view of the resilient expander shown in FIG. 15.
Figure 17:
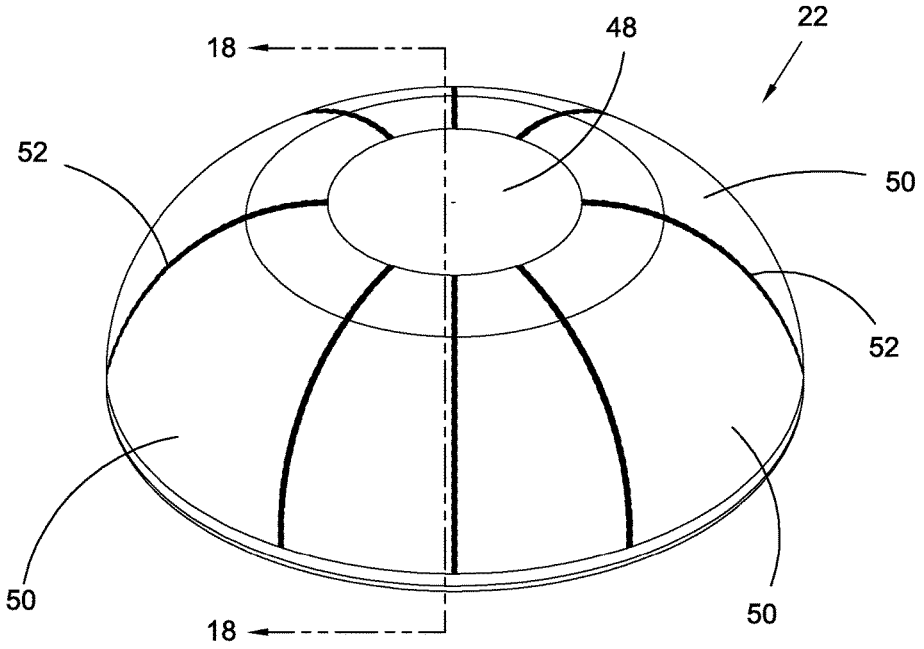
FIG. 17 is a top perspective view of an embodiment of a marker packet used in the embodiment of the non-lethal projectile shown in FIG. 1.
Figure 18:
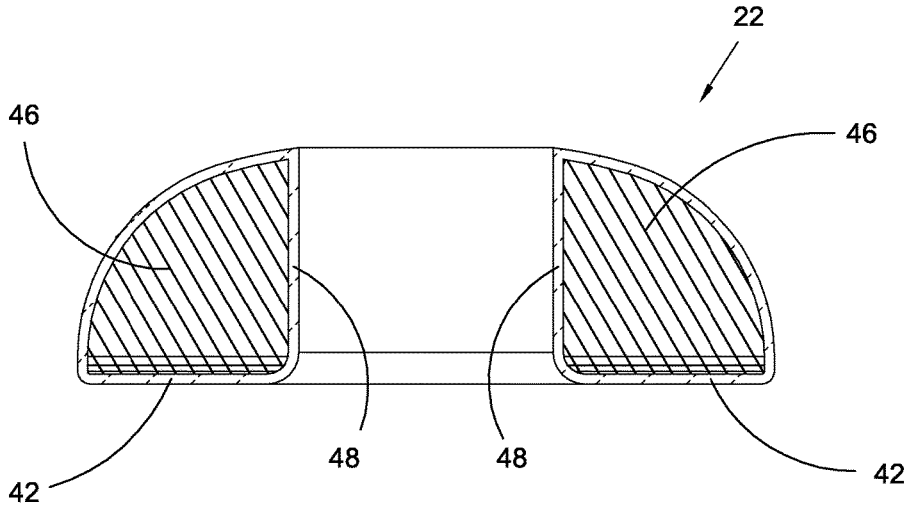
FIG. 18 is a cross sectional view of the marker packet shown in FIG. 17 taken generally along line 18-18 of FIG. 17.
Figure 19:
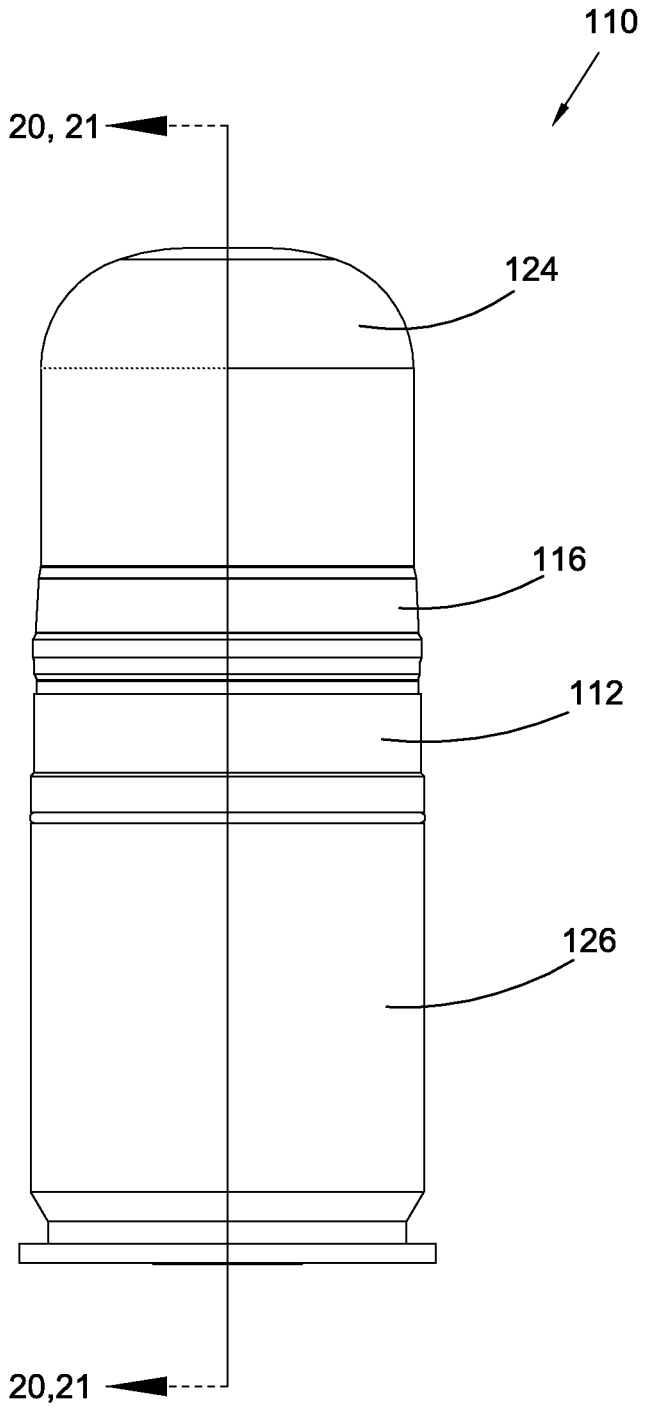
FIG. 19 is a side elevational view of another embodiment of a present invention non-lethal projectile.
Figure 20:
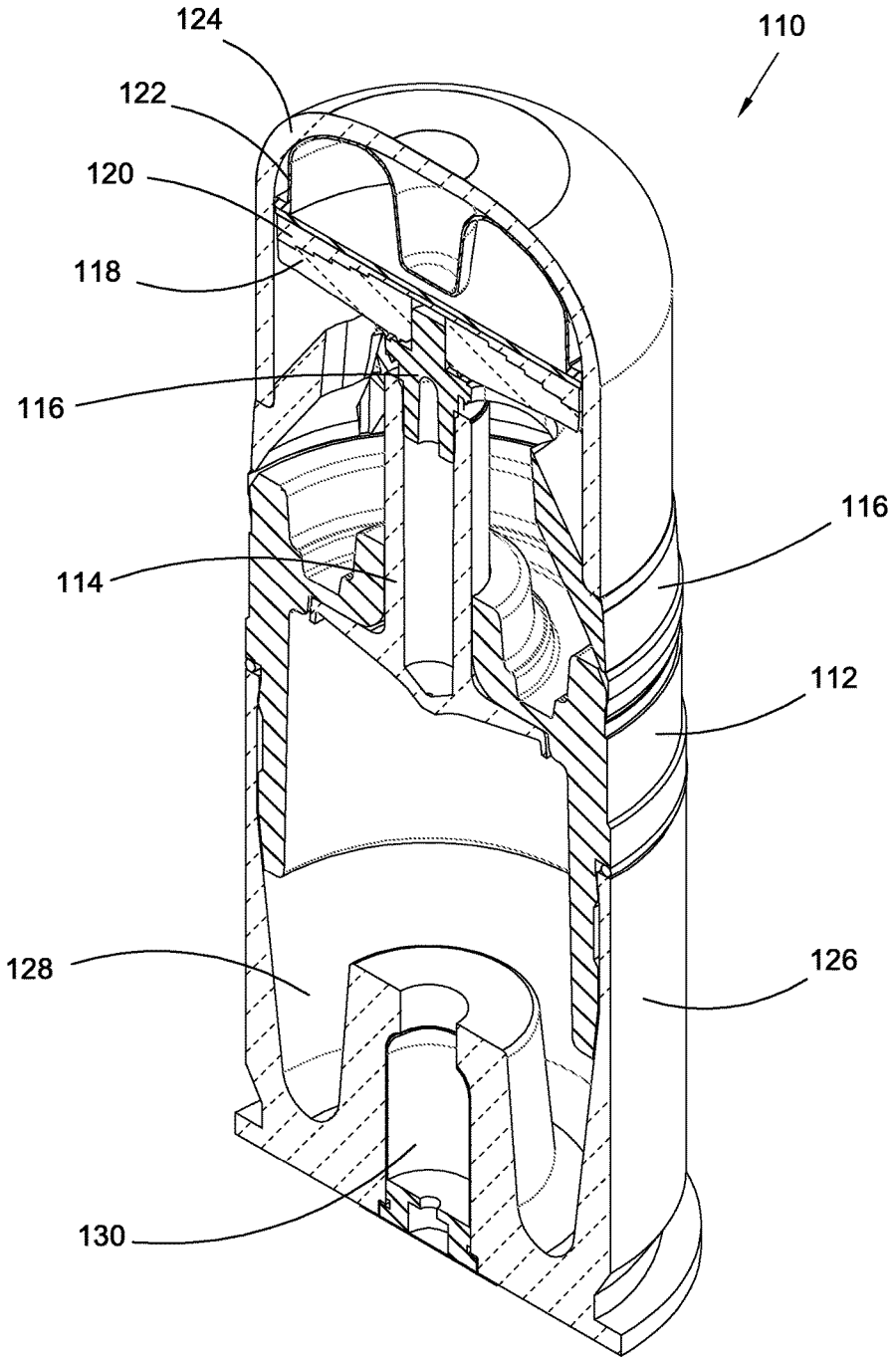
FIG. 20 is a cross sectional perspective view of the non-lethal projectile shown in FIG. 19 taken generally along line 20-20 of FIG. 19.
Figure 21:
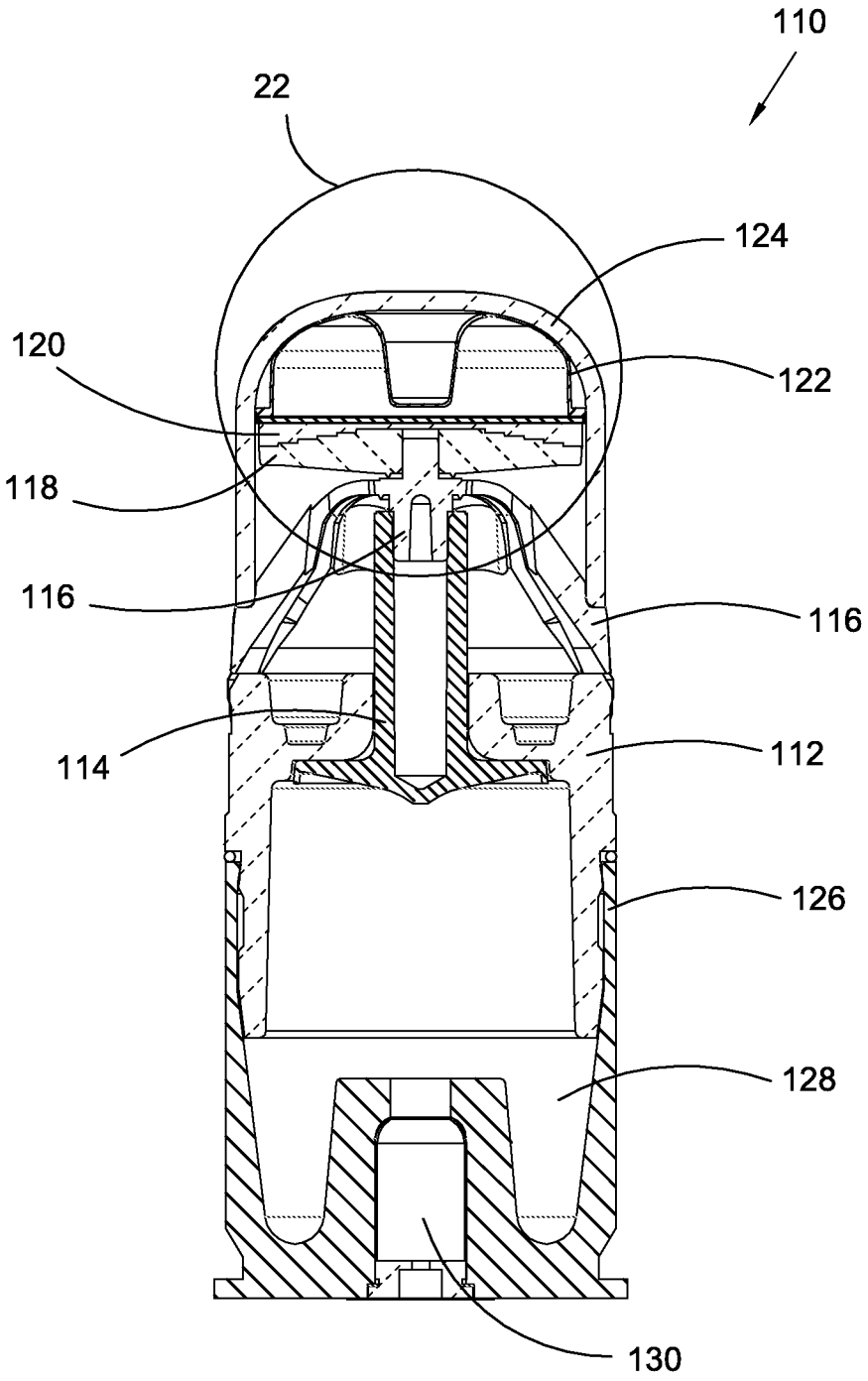
FIG. 21 is a cross sectional view of the non-lethal projectile shown in FIG. 19 taken generally along line 21-21 of FIG. 19.
Figure 22:
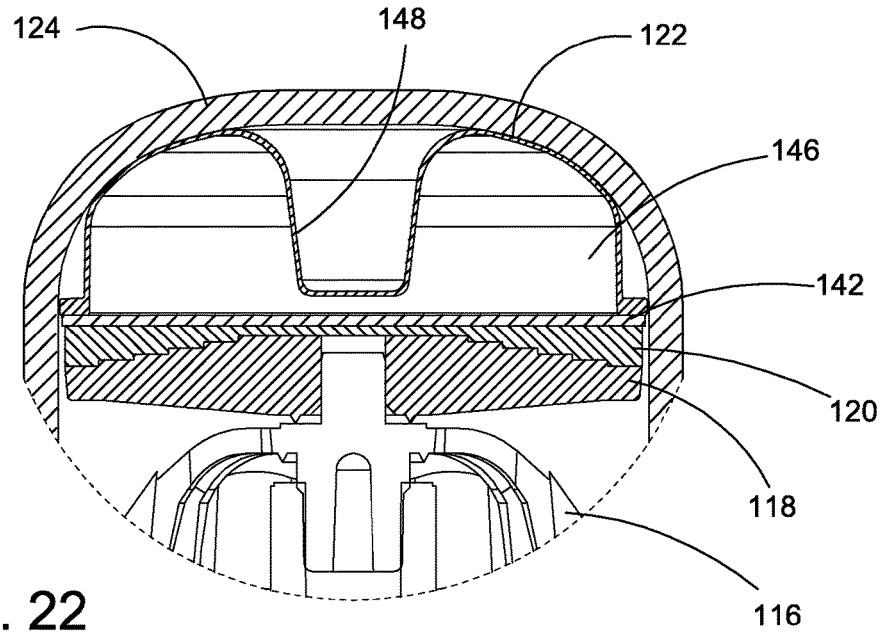
FIG. 22 is an enlarged cross sectional view of the encircled region 22 shown in FIG. 21.
Figure 23:
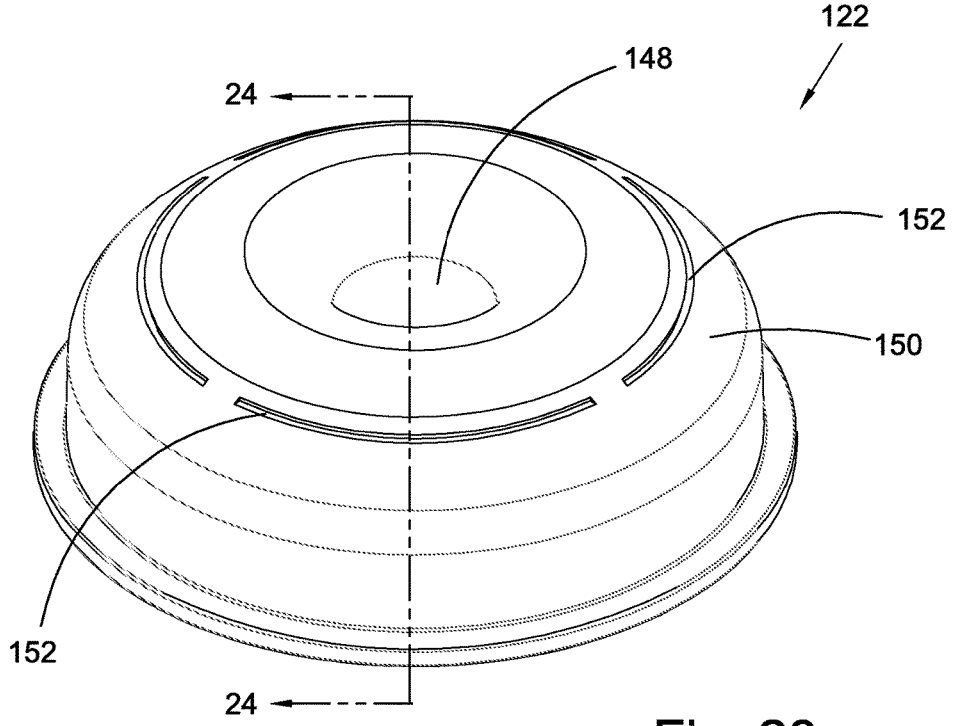
FIG. 23 is a top perspective view of another embodiment of a marker packet used in the embodiment of the non-lethal projectile shown in FIG. 19.

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood in one of ordinary skill in the art to which these embodiments belong. As used herein, the term "average" shall be construed broadly to include any calculation in which a result datum or decision is obtained based on a plurality of input data, which can include but is not limited to, weighted averages, yes or no decisions based on rolling inputs, etc. Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Although any methods, devices or materials similar or equivalent to those described herein can be used in the practice or testing of the invention, the preferred methods, devices, and materials are now described.

Non-lethal projectile 10 comprises frame 12, guide expander 14, expander base 16, expander cap 18, resilient expander 20, marker packet 22 and cone 24. Projectile 10 is positioned within shell 26. Volume 28 of shell 26 acts as a combustion chamber. The propellant is ignited via a primer located inside a .38 caliber shell casing (not shown). The .38 caliber shell casing is positioned in bore 30 of shell 26. The propellant is selected from those well known in the art and is not particularly germane to the present device. Upon ignition of the propellant, projectile 10 exits shell 26 in the direction of firing. Upon impact with a target, cone 24 collapses, expander base 16 expands outwardly, resilient expander 20 compresses and expands outwardly, and marker packet 22 ruptures, thereby dispersing the payload and collectively absorbing kinetic energy from the moving projectile 10 and decreasing its damage and/or injury to the target.

Expander base 16 is arranged to "fail" thereby absorbing kinetic energy. Expander base 16 comprises expander base segments 64 which are connected by weakened regions 66. Upon impact with a target, a longitudinal compression force is imparted on cone 24 and thereby on the resilient expander 20, expander cap 18, expander base 16 and guide expander 14. As the foregoing elements compress, frame 12 slides relative to guide expander 14 and is pushed against expander base 16. Frame 12 in turn causes expander base segments 64 to be pushed outwardly. Provided sufficient force is imparted on base segments 64, weakened portions 66 fail thereby permitting further expansion of base segments 64. The expansion of base segments 64 in combination with the failure of weakened portions 66 further absorbs kinetic energy of the moving projectile 10. In the expanded form, expander base 16 forms a star-like structure. In addition to the foregoing absorption of energy, the inertia of projectile 10 is further dissipated by the compression of expander cap 18 against base 80 of resilient expander 20. This action assists with the rupturing of marker packet 22, as described in further detail infra. It should be appreciated that although expander base 16 and expander cap 18 are depicted as separate elements joined together, a single element can also be formed. However, due to present savings in manufacturing, the two piece arrangement is preferred.

Resilient expander 20 is formed from a flexible material, e.g., silicone. As non-lethal projectile 10 impacts a target, extension 82 of resilient expander 20 is compressed in the direction depicted by uni-directional arrow 38 and thereby expands in the directions of uni-directional arrows 40. It should be appreciated that although the expansion of extension 82 is depicted by only two arrows 40, extension 82 is cylindrical in shape. Therefore, as extension 82 is compressed in the direction of arrow 38, extension 82 expands outwardly in substantially all radial directions including the directions depicted by arrows 40. Moreover, as expander cap 18 impacts base 80 of resilient expander 20, base 80 transfers kinetic energy to base 42 of marker packet 22, i.e., transfers kinetic energy in the direction of uni-directional arrows 44.

Resilient expander 20 assists in the dispersion of payload 46 from marker packet 22 on the target. Expander 20 also absorbs inertia, i.e., kinetic energy, creates a fixture for marker packet 22 and acts as a safety barrier preventing components below resilient expander 20 from impacting a target directly. In flight, marker packet 22 is stabilized in cone 24 of projectile 10 by resilient expander 20. During impact, extension 82 expands outwardly into inner surface 48 of marker packet 22 and base 80 of expander 20 compresses against base 42 of marker packet 22, collectively creating a higher pressure vessel thereby dispersing payload 46 in a desirable pattern. To ensure the plastic components of projectile 10 will not penetrate the target, e.g., guide expander 14, expander base 16, and expander cap 18, base 80 acts as a safety barrier blocking the plastic components from moving forward upon impact. The elasticity of resilient expander 20 also absorbs some inertia from projectile 10 making it less likely to injure a target.

In an embodiment, marker packet 22 is a partial toroid shaped component formed from a material such as polyethylene. Marker packet 22 acts as a pressure vessel when a target is hit. High pressure that develops upon impact in combination with segments 50 allow for proper outward dispersion of payload 46 onto the target. In other words, a compressive force is applied to the impacting surface of packet 22, a compressive force is applied to base 42 by base 80 of expander 20, and a compressive force is applied to surface 48 by extension 82, collectively pushing inwardly on payload 46. This collective force creates a higher pressure within packet 22 thereby providing the means to effectively disperse payload 46 on a target. Segments 50 are defined and separated by etched or weakened portions 52 in the top portion of marker packet 22. In short, upon reaching a sufficient pressure, weakened portions 52 fail or open thereby permitting dispersion of payload 46. The foregoing arrangement of marker packet 22 also facilitates the dispersion of its kinetic energy over a larger surface area creating a projectile less likely to cause injury to a target.

In addition to the above described payloads that may be carried by the present invention non-lethal projectile, the payload may also include a tagging and/or marking agent, as well as an infrared liquid or powder. Tagging agents, such as forensic marking agents, provide greater capability for the present projectile, e.g., tagging a party prior to fleeing a scene for later identification and arrest. Thus, for example, a participant of a riot may be impacted with a present projectile carrying a forensic marking agent and even if that participant leaves the scene of the riot prior to arrest, law enforcement agents can later identify that person as a participant due to the presence of the marking agent. Such marking agents can effectively code a person, object, etc., for later identification. Forensic marking agents can be configured with unique formulas so that the later identification can provide information related to where the person was tagged or who tagged the person, i.e., each law enforcement agent could have a unique marking agent which will be undetectable by the person being tagged. Moreover, not only does the foregoing marking agent tag a person's clothing, but the marking agent also propagates to skin and unexposed clothing so that if a person removes the clothing that was actually impacted by the present invention projectile, the marking agents are still detectable later in time. An example of a forensic marking liquid is the SMARTWATER® product offered by SmartWater CSI LLC of Fort Lauderdale, Fla. and SmartWater Technology Ltd. of London, England.

Other embodiments of the present invention non-lethal projectile have also been developed. Non-lethal projectile 110 comprises frame 112, guide expander 114, expander base 116, expander cap 118, resilient layer 120, marker packet 122 and cone 124. Projectile 110 is positioned within shell 126. Volume 128 of shell 126 acts as a combustion chamber. The nature of firing projectile 110 is substantially the same as the firing of projectile 10 described above. However, upon impact with a target, cone 124 collapses, expander base 116 expands outwardly, resilient layer 120 compresses surface 142 of marker packet 122, and marker packet 122 ruptures, thereby dispersing the payload and collectively absorbing kinetic energy from the moving projectile 110 and decreasing its damage and/or injury to the target.

Similar to the embodiment described above, expander base 116 is arranged to "fail" thereby absorbing kinetic energy. Upon impact with a target, a longitudinal compression force is imparted on cone 124 and thereby on the resilient layer 120, expander cap 118, expander base 116 and guide expander 114. As the foregoing elements compress, frame 112 slides relative to guide expander 114 and is pushed against expander base 116. Frame 112 in turn causes expander base 116 to fail, pushing the segments forming base 116 outwardly, thereby absorbing kinetic energy of the moving projectile 110. lithe expanded form, expander base 116 forms a star-like structure. In addition to the foregoing absorption of energy, the inertia of projectile 110 is further dissipated by the compression of expander cap 118 against resilient layer 120. This action assists with the rupturing of marker packet 122, as described in further detail infra.

Resilient layer 120 is formed from a flexible material, e.g., silicone. As non-lethal projectile 110 impacts a target, resilient layer 120 is compressed against seal layer 142 of marker packet 122. Moreover, as expander cap 118 impacts resilient layer 120, expander cap 118 transfers kinetic energy to seal layer 142 of marker packet 122.

Resilient layer 120 assists in the dispersion of payload 146 from marker packet 122 on the target, layer 120 also absorbs inertia, i.e., kinetic energy, fills the gap between cap 118 and layer 142 and acts as a safety barrier preventing components below resilient layer 120 from impacting a target directly. During impact, layer 120 compresses against sealing layer 142 creating a higher pressure vessel thereby dispersing payload 146 in a desirable pattern. To ensure the plastic components of projectile 110 will not penetrate the target, e.g., guide expander 114, expander base 116, and expander cap 118, layer 120 also acts as a safety barrier blocking the plastic components from moving forward upon impact. The elasticity of layer 120 also absorbs some inertia from projectile 110 making it less likely to injure a target.

In an embodiment, marker packet 122 is a partial toroid shaped component comprising wall 150 formed from a material such as high density polyethylene (HDPE). Marker packet 122 further comprises sealing layer 142. Layer 142 is secured to the base of wall 150 by any means known in the art, e.g., induction sealing, and is formed from a material that is compatible with payload 146 so that layer 142 does not deteriorate prior to use, e.g., during storage of the projectile. For example, layer 142 may be formed from ExpressWeb EFS 174 manufactured by Glenroy Inc. of Menomonee Falls, Wis. Suitable sealing layers may include but are not limited to materials including at least one of: polyester; low density polyethylene; aluminum foil; and, linear low density polyethylene. It should be appreciated that layer 142 may also be formed as a multi-layer composite including some or all of the aforementioned materials. Marker packet 122 acts as a pressure vessel when a target is hit. High pressure that develops upon impact in combination with wall 150 allows for proper outward dispersion of payload 146 onto the target. In other words, a compressive force is applied to the impacting surface of packet 122, a compressive force is applied to sealing layer 142 by resilient layer 120, collectively pushing inwardly on payload 146. This collective force creates a higher pressure within packet 122 thereby providing the means to effectively disperse payload 146 on a target. Wall 150 is defined and separated by etched or weakened portions 152 in the top portion of marker packet 122. In short, weakened portions 152 cause a controlled failure mode of marker packet 122 when pressurized by impact, i.e., wall 150 fails along the length of each weakened portions 152. The foregoing arrangement of marker packet 122 facilitates the dispersion of its kinetic energy over a larger surface area creating a projectile less likely to cause injury to a target.

Figure 24:
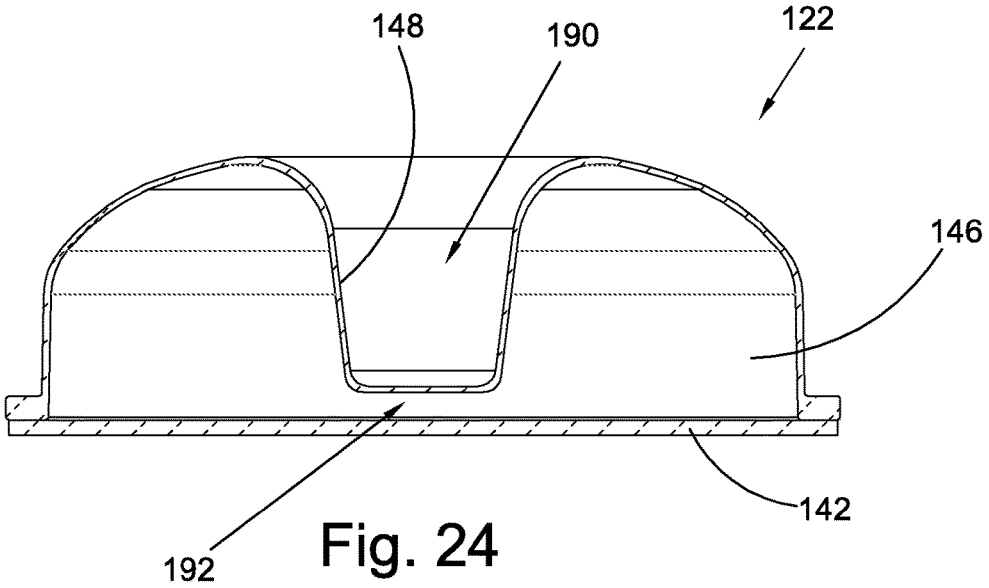
FIG. 24 is a cross sectional view of the marker packet shown in FIG. 23 taken generally along line 24-24 of FIG. 23; and, FIG. 25 is a cross sectional view of another embodiment of a marker packet which may be used in the embodiment of the non-lethal projectile shown in FIG. 19.
Figure 25:
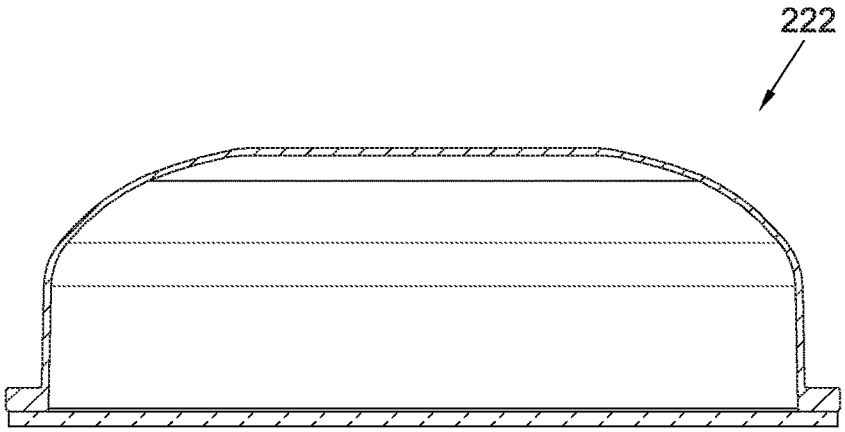

In addition to the foregoing, marker packet 122 comprises inner surface 148. In this embodiment, inner surface 148 does not form a complete through hole in marker packet 122. As can be best understood in view of FIG. 24, the base of opening 190 does not contact sealing layer 142. Thus, gap 192 is formed between inner surface 148 and sealing layer 142. The gap may be larger or smaller than depicted in the figures, or alternatively, no gap may be present. It is believed that the size of gap 192 also contributes to the nature of the dispersion of payload 146 during impact with a target. Embodiments falling within the spirit and scope of the claimed invention include full through holes, e.g., marker packet 22, and partial through holes, e.g., marker packet 122. Moreover, it is contemplated that no opening may be included, and that those embodiments will form a domed structure devoid of indentations or openings in the middle of the marker packet, e.g., marker packet 222.

The present embodiments provide non-lethal projectiles that outperform alternate designs. For example, the present invention was compared against three alternate designs for viscous criterion (VC) and impact force. The foregoing tests used various impact velocities to measure impact force, dynamic deflection and impact velocity to quantify the performance of each design. The present embodiments provided lower impact force and lower viscous criterion than each other tested design.

The impact of the present invention non-lethal projectile on a target creates two impacts of inertia on the target. The present invention causes a dispersion of inertia on the target. Upon impact, the present projectile provides an initial dispersion of inertia on the target, and subsequently as the frame and in turn the guide expander pushes into the expander base, a second dispersion of inertia on the target occurs. Furthermore, the size of the cone of the present invention causes a wide area dispersion of force on a target which spreads kinetic energy to more nerve endings thereby causing more pain compliance while decreasing injury due to lack of penetration.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

REFERENCE NO. LISTING

10—non-lethal projectile
12—frame
14—guide expander
16—expander base
18—expander cap
20—resilient expander
22—marker packet
24—cone
26—shell
28—volume
30—bore
38—uni-directional arrow
40—uni-directional arrow
42—base
44—uni-directional arrow
46—payload
48—inner surface
50—segment
52—weakened portion
54—hollow frame body
56—upper end cap
58—through bore
60—guide expander base
62—cylindrical guide
64—expander base segment
66—weakened portion
68—upper protrusion
70—lower protrusion
72—upper surface
74—lower surface
76—circular planar surface
78—through bore
80—base
82—extension
84—upper surface
86—lower surface
110—non-lethal projectile
112—frame
114—guide expander
116—expander base
118—expander cap
120—resilient layer
122—marker packet
124—cone
126—shell
128—volume
130—bore
142—sealing layer
146—payload
148—inner surface
150—wall
152—weakened portion
190—opening
192—gap
222—marker packet

What is claimed is:

1. A non-lethal projectile comprising:

a frame comprising a substantially cylindrical hollow body, a closed upper end and a through bore centrally disposed within the closed upper end and coaxially arranged with the substantially cylindrical body;

a guide expander comprising a cylindrical guide and a base, wherein the cylindrical guide is disposed within the bore and longitudinally displaceable therein;

an expander base comprising a plurality of segments, a lower protrusion and an upper protrusion, wherein the guide expander contacts the lower protrusion and each segment of the plurality of segments is connected to each adjacent segment by a weakened portion;

an expander cap comprising an upper surface comprising a plurality of offset circular planar surfaces and a through bore centrally disposed and contacting the upper protrusion of the expander base;

a resilient layer, wherein the upper surface of the expander cap contacts a lower surface of the resilient layer;

a marker packet comprising a hollow body comprising a lower surface, at least a partial opening centrally disposed, an upper surface, a volume formed by the lower surface, the at least a partial opening and the upper surface and a payload contained within the volume, wherein the upper surface of the marker packet comprises a wall and at least one weakened portion within the wall, and the lower surface of the marker packet contacts an upper surface of the resilient layer; and, a cap arranged to enclose the marker packet, the resilient layer and the expander cap, and partially enclose the expander base, wherein the payload is dispersed on or near a target upon impact by the non-lethal projectile.

2. The non-lethal projectile of claim 1 wherein the resilient layer further comprises a base and an extension, wherein the upper surface of the expander cap contacts a lower surface of the base.

3. The non-lethal projectile of claim 2 wherein the at least a partial opening in the marker packet comprises a through hole, and the extension of the resilient layer is disposed within the through hole.

4. The non-lethal projectile of claim 1 wherein the wall of the upper surface of the marker packet comprises a plurality of wall segments, and each of the plurality of wall segments is connected to each adjacent wall segment by a weakened portion.

5. The non-lethal projectile of claim 1 wherein the wall of the upper surface of the marker packet is formed from a thermoplastic material.

6. The non-lethal projectile of claim 5 wherein the thermoplastic is a high density polyethylene.

7. The non-lethal projectile of claim 1 wherein the lower surface of the marker packet is formed from a multi-layer composition.

8. The non-lethal projectile of claim 7 wherein the multi-layer composition comprises at least of: polyester; low density polyethylene; aluminum foil; and, linear low density polyethylene.

9. A non-lethal projectile comprising:

a frame comprising a substantially cylindrical hollow body, a closed upper end and a through bore centrally disposed within the closed upper end and coaxially arranged with the substantially cylindrical body;

a guide expander comprising a cylindrical guide and a base, wherein the cylindrical guide is disposed within the bore and longitudinally displaceable therein;

an expander base comprising a plurality of segments, a lower protrusion and an upper protrusion, wherein the guide expander contacts the lower protrusion and each segment of the plurality of segments is connected to each adjacent segment by a weakened portion;

an expander cap comprising an upper surface comprising a plurality of offset circular planar surfaces and a through bore centrally disposed and contacting the upper protrusion of the expander base;

a resilient expander comprising a base and an extension, wherein the upper surface of the expander cap contacts a lower surface of the base;

a marker packet comprising a hollow body comprising a lower surface, a central opening, an upper surface, a volume formed by the lower surface, the central opening and the upper surface and a payload contained within the volume, wherein the upper surface of the marker packet comprises a plurality of segments, each segment of the plurality of segments is connected to each adjacent segment by a weakened portion, the extension of the resilient expander is disposed within the central opening, and the lower surface of the marker packet contacts an upper surface of the base of the resilient expander; and, a cap arranged to enclose the marker packet, the resilient expander and the expander cap, and partially enclose the expander base, wherein the payload is dispersed on or near a target upon impact by the non-lethal projectile.

* * * * *